United States Patent [19]

Spiewok

[11] 4,430,221

[45] Feb. 7, 1984

[54] CENTRIFUGE SIEVE

[75] Inventor: Leonhard Spiewok, Wallisellen, Switzerland

[73] Assignee: Escher Wyss Limited, Zurich, Switzerland

[21] Appl. No.: 395,142

[22] Filed: Jul. 6, 1982

[30] Foreign Application Priority Data

Jul. 24, 1981 [CH] Switzerland ..... 4826/81

[51] Int. Cl.[3] ..... B04B 3/00; B04B 7/16

[52] U.S. Cl. ..... 210/380.1; 210/541; 209/406

[58] Field of Search ..... 210/380.1, 380.2, 380.3, 210/381, 360.1, 541; 156/293; 428/136; 209/406

[56] References Cited

U.S. PATENT DOCUMENTS

| | | | |
|---|---|---|---|
| 3,100,746 | 8/1963 | Holowaty | 209/304 |
| 4,157,966 | 6/1979 | Hassall | 210/380.1 |
| 4,259,136 | 3/1981 | Spiewok | 159/293 |

*Primary Examiner*—John Adee

*Attorney, Agent, or Firm*—Werner W. Kleeman

[57] ABSTRACT

In a centrifuge sieve drum wherein the inner surface of the drum is lined with a support arrangement which carries wear-resistant sieve or screen rods formed of a hard material, there is obtained a compensation of the different thermal expansions of the sieve or screen rods and the support arrangement in that, the sieve or screen rods are fixedly connected, in each case, as by riveting or by a threaded connection, at one location with the support arrangement of the sieve drum, whereas the rivets or threaded screws at other connection locations are moveable in a slot-shaped or elongate hole in the axial direction of the sieve drum.

13 Claims, 4 Drawing Figures

CENTRIFUGE SIEVE

BACKGROUND OF THE INVENTION

The present invention relates to a new and improved construction of centrifuge sieve or screen containing a support arrangement bearing at the inner surface or wall of a centrifuge drum, wherein at least at two locations there are secured sieve or screen rods extending in the axial direction of the centrifuge drum and formed of a wear-resistant hard material.

With such type of centrifuge sieves or screens, which are known to the art, for instance from U.S. Pat. No. 4,313,992, granted Feb. 2, 1982 and U.S. Pat. No. 4,259,136, granted Mar. 31, 1981, the centrifuge drums are protected against wear by wear-protecting hard material rods connected by adhesive bonds at the support arrangement of the drum. For the purpose of compensating for the different thermal expansions of the sieve or screen rods formed of a hard material and the support arrangement composed of a material having a different coefficient of thermal expansion, there are provided for such connection elastic intermediate layers, for instance rubber intermediate elements. However, during operation such elastic intermediate layers do not possess a sufficient service life, are not temperature-resistant and not corrosion-resistant. Additionally, they allow for a mobility in a number of directions, resulting in undesired and impermissible deformations of the sieve or screen rods and the support arrangement with respect to one another. Additionally, what is disadvantageous with this equipment design is the poor working properties, and the difficult assembly which is particularly unsuitable for mass production.

SUMMARY OF THE INVENTION

Therefore, with the foregoing in mind it is a primary object of the present invention to provide a new and improved construction of a centrifuge sieve or screen which is not associated with the aforementioned drawbacks and limitations of the prior art.

Another and more specific object of the present invention aims at avoiding the previously discussed drawbacks of the state-of-the-art constructions and providing a centrifuge sieve or screen, wherein the sieve or screen rods formed of the hard material possess a relatively long service life, are temperature and corrosion-resistant, can be moved in a defined manner against the support arrangement and can be connected therewith and can be easily fabricated and assembled.

Now in order to implement these and still further objects of the invention, which will become more readily apparent as the description proceeds, the centrifuge sieve or screen of the present development is manifested by the features that, the sieve or screen rods are fixedly connected at one location with the support arrangement, whereas at other locations there are provided connections which afford a mobility of the sieve or screen rods in relation to the support arrangement only in the axial direction.

A particularly advantageous solution is realized if the connections are constituted by rivets, and the sieve rods formed of a hard material are fixedly riveted in each case at one location with the support arrangement, whereas at the other connection locations there are provided rivets at the sieve rods and which rivets are moveable in slots or elongate holes or the like provided at the support arrangement, these slots extending in the axial direction of the centrifuge drum. However, instead of using rivets there also could be employed other suitable connection elements, for instance screws, pins, threaded bolts or the like.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
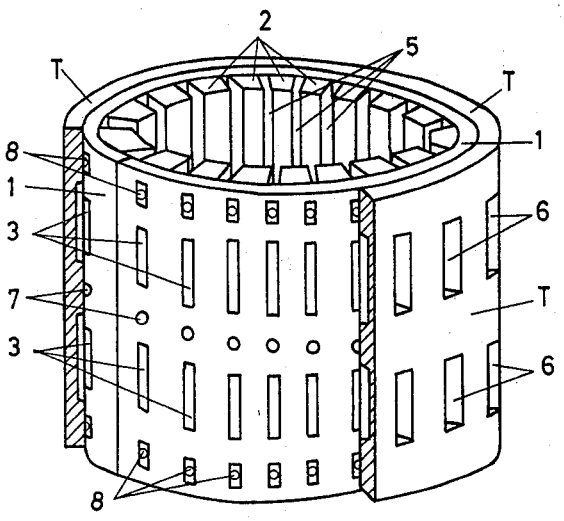
FIG. 1 is a perspective view of a centrifuge sieve or screen according to the invention.
Figure 2:
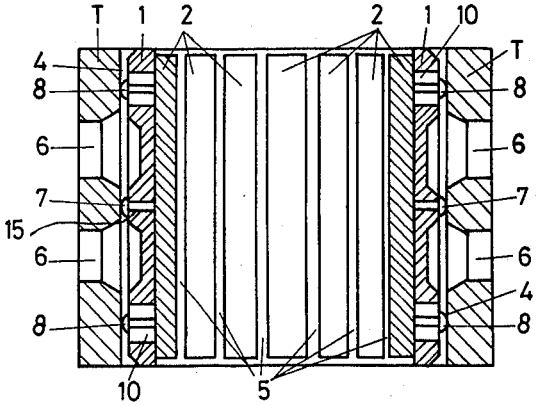
FIG. 2 is an axial sectional view through the centrifuge sieve of FIG. 1.
Figure 3:
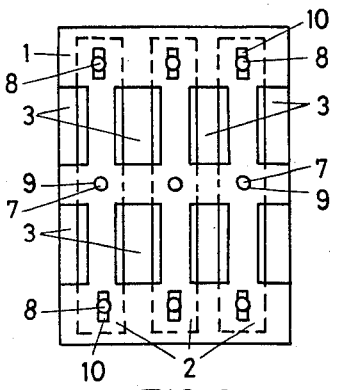
FIG. 3 is a detailed section of part of the drum outer wall of the centrifuge sieve of FIG. 1.

Describing now the drawings, the exemplary embodiment of centrifuge sieve or screen depicted in FIGS. 1, 2 and 3 will be seen to comprise a substantially cylindrical centrifuge drum T possessing a drum diameter in the decimeter up to the meter range. At the inner surface or wall of the centrifuge drum T there bears a sieve or screen-like support arrangement 1. At the inner surface of this sieve-like support arrangement 1 there are secured, in the axial direction of the centrifuge drum T at a slight lateral spacing from one another, a multiplicity of sieve or screen rods 2 which likewise provide a wear protection. These sieve or screen rods 2 are formed of a hard material and possess a thickness of several millimeters and a length amounting up to about 30 centimeters.

The support arrangement or mechanism 1 is constructed from a suitable metal, for instance steel, and possesses sieve or screen slots or holes 3 or equivalent passages for the throughflow of the filtrate during centrifuging. Instead of this arrangement it would be possible, however, for the support arrangement 1 to consist of a framework formed of rings or ring members which are interconnected with one another by axially parallelly extending rods, so that there are formed between the rods the required sieve slots or the like. At the inner surface or wall of the centrifuge drum T there are provided substantially ring-shaped webs 4 upon which bears the support arrangement or mechanism 1. A throughpassage for the filtrate is formed by the intermediate spaces 5 between the spaced sieve rods 2, the slots 3 of the support arrangement 1 located therebelow, and the slots 6 in the centrifuge drum T which are offset with respect to the slots 3.

As stated, the sieve rods or rod members 2 are advantageously formed of a wear-resistant hard material, for instance, cast basalt or a sintered material, such as sintered ceramics or sintered carbide, for instance tungsten carbide. Since during operation of the centrifuge there can arise considerable temperature fluctuations up to 100° C., it is necessary because of the markedly different thermal expansion of the hard material, for instance the tungsten carbide, and the material from which there is formed the support arrangement 2, for instance steel, to undertake measures during the attachment of the sieve rods 2 at the support arrangement 1 which ensure for a length compensation, in order to thereby avoid undesirable deformation and fracture of the sieve or screen rods 2. For this purpose there are attached, for instance soldered at the sieve or screen rods 2 a number of connection elements, for instance rivets 7 and 8 formed of stainless, high-alloy steel, and if necessary, depending upon the material, provided with suitable transition layers known as such to those skilled in the art, and merely generally represented in FIG. 2 by reference numeral 15. The support arrangement 1 is provided with suitable rivet holes or bores 9 and 10, as best seen by referring to FIG. 3. For one of the rivets, in the illustrated exemplary embodiment, the intermediate rivets 7 the corresponding rivet holes 9 have a circular configuration, so that during riveting there is formed a fixed, immobile connection between the related sieve rod 2 and the support arrangement 1. On the other hand, all of the other rivet holes 10 for the remaining rivets 8 are in the form of elongate slots or slot-shaped holes 10 extending in the axial direction. The riveting is accomplished in such a manner that the sieve rods 2, while being immobile in radial direction, nonetheless there is possible only in the lengthwise direction, in other words in the axial direction of the centrifuge drum, a length compensation. In the circumferential direction there is precluded any movement of the sieve rods 2 due to the axial extent of the slots 10. Conceptually, the connection elements 7 and 8 may also be considered to be constituted by, for instance, screws, pins or threaded bolts.

By virtue of the described arrangement there is attained a defined mobility of the sieve rods 2 with respect to the support arrangement 1 only in the direction of expansion or elongation, i.e. in the lengthwise direction of the sieve rods 2. Specifically, this defined mobility is accomplished solely by using extremely permanent and temperature and corrosion resistant materials. In comparison to the known centrifuge sieves or screens employing elastic rubber or plastic connection elements, it is possible with the described arrangement, during practical operations, to enhance the service life by a multiple and to appreciably improve the corrosion resistance. A further advantage is constituted by the significantly easier exchange of the sieve or screen rods 2.

Figure 4:
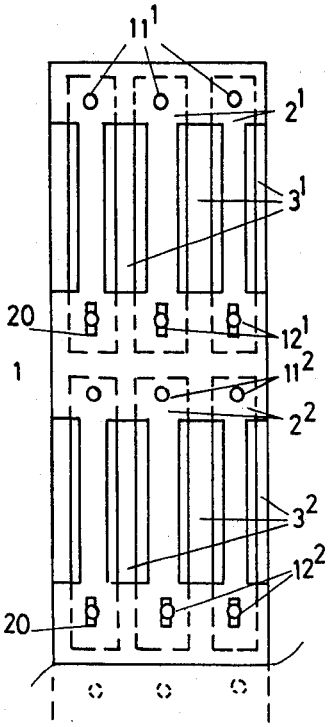
FIG. 4 illustrates a detail of the drum outer wall of a different construction of centrifuge sieve or screen.

While with the exemplary embodiment depicted in FIGS. 1, 2 and 3 the sieve or screen rods 2 are fixedly riveted at the center and possess at both ends a certain mobility, the modified construction of centrifuge sieve or screen depicted in FIG. 4 embodies an arrangement wherein a number of layers or groups of sieve rods $2^1$, $2^2$ are arranged at a slight spacing behind one another in the axial direction. Each of the sieve rods $2^1$, $2^2$ is fixedly and immobilely riveted with the support arrangement 1 at one end $11^1$, $11^2$, respectively, and at the other end $12^1$, $12^2$ is moveable in the axial direction through the provision of the slot-shaped rivet holes 20. Between the sieve rods $2^1$, $2^2$ there are provided in the support arrangement or mechanism 1 a number of rows of sieve slots $3^1$, $3^2$, through which there can outflow the filtrate. In comparison to the first exemplary embodiment of centrifuge sieve, it is here possible through the use of a number of layers or groups of sieve rods to attain a greater length of the sieve drum, amounting to as much as several meters. This is particularly advantageous in the case of sintered materials which only allow for a limited rod length. The support arrangement, with this modified embodiment of centrifuge sieve, likewise can consist of a number of parts arranged behind one another or in tandem in the axial direction, and each support arrangement part can carry, for instance, only one of the sieve rod layers or groups.

It should be here remarked that instead of using rivets, as was the case for the previously described embodiments, there could be employed other suitable connection elements while practicing the teachings and principles of the invention, for instance connection screws, pins or bolts, which engage in appropriate holes or bores. Here also in each case one of the holes for each sieve rod is or instance circular and the remaining holes elongate, oval or slot-shaped in their configuration, in order to allow for the desired mobility in the axial direction.

While there are shown and described present preferred embodiments of the invention, it is to be distinctly understood that the invention is not limited thereto, but may be otherwise variously embodied and practiced within the scope of the following claims. Accordingly,

What I claim is:

1. A centrifuge sieve comprising:

a centrifuge drum having an inner surface;

a support arrangement bearing at the inner surface of said centrifuge drum;

sieve rods secured at the support arrangement at least at two locations and extending in axial direction of the centrifuge drum;

said sieve rods being formed of a wear-resistant hard material;

connection means for fixedly connecting the sieve rods at one location with the support arrangement; and connection means provided at the other of said two locations between the sieve rods and the support arrangement in order to enable a mobility of the sieve rods in relation to the support arrangement only in the axial direction.

2. The centrifuge sieve as defined in claim 1, wherein: said connection means comprise rivets.

3. The centrifuge sieve as defined in claim 1, wherein: said connection means comprise screws.

4. The centrifuge sieve as defined in claim 1, wherein: said connection means comprise pins.

5. The centrifuge sieve as defined in claim 1, wherein: said connection means comprise bolts.

6. The centrifuge sieve as defined in claim 1, wherein:

each of said connection means comprise connection elements;

one connection of each sieve rod with the support arrangement constitutes a fixedly seated connection whereas the other connection of each of said sieve rod with the support arrangement is established by the connection element thereof engaging into a slot extending in the axial direction.

7. The centrifuge sieve as defined in claim 6, wherein:

said slots are provided in the support arrangement; and said connection elements are soldered to the sieve rods.

8. The centrifuge sieve as defined in claim 7, further including:

transition layer means provided between the connection elements and the sieve rods.

9. The centrifuge sieve as defined in claim 1, wherein: said sieve rods are formed of a sintered material.

10. The centrifuge sieve as defined in claim 9, wherein:

said sintered material is a sintered ceramic.

11. The centrifuge sieve as defined in claim 9, wherein:

said sintered material is a sintered carbide.

12. The centrifuge sieve as defined in claim 9, wherein:

said sintered material is a cast basalt.

13. The centrifuge sieve as defined in claim 9, wherein:

said sintered material is tungsten carbide.

* * * * *